US005485989A

United States Patent [19]

McCay et al.

[11] Patent Number: 5,485,989

[45] Date of Patent: Jan. 23, 1996

[54] DIVERTER AND ON-EDGE STACKER

[75] Inventors: Steve W. McCay, Morrisville; Keith A. Harshman, Apex, both of N.C.; Stephen J. Gillette, Whitehall; Dale A. Wentzel, Blandon, both of Pa.

[73] Assignee: Bell & Howell Phillipsburg Company, Lehigh Valley, Pa.

[21] Appl. No.: 288,106

[22] Filed: Aug. 10, 1994

[51] Int. Cl.[6] ..... B65H 5/00

[52] U.S. Cl. ..... 271/2; 271/225; 271/286; 271/176; 271/178; 271/182; 271/184

[58] Field of Search ..... 271/286, 285, 271/280, 176, 178, 182, 184, 315, 225, 2; 198/410, 457

[56] References Cited

U.S. PATENT DOCUMENTS 4,051,957 10/1977 Parups ..... 271/184 X 5,029,832 7/1991 Orsinger et al. ..... 270/54

5,201,504 4/1993 Fallos ..... 271/2

*Primary Examiner*—David H. Bollinger

*Attorney, Agent, or Firm*—Millen, White, Zelano & Branigan

[57] ABSTRACT

A diverter and on-edge stacker for diverting and on-edge stacking of envelopes comprises: an envelope conveying path; a device for selectively diverting a conveyed envelope by intercepting a lateral portion of the leading envelope edge and thereby skewing the envelope; a stepper-motor-driven spider wheel having legs and gaps therebetween for receiving diverted envelopes; revolving rollers to capture and drive the skewed envelope away from the conveying path into a gap of the momentarily stationary spider wheel; and, a sensor to sense an envelope that has been driven into a spider wheel gap and, consequently, to control rotation of the spider wheel by one gap pitch.

20 Claims, 4 Drawing Sheets

DIVERTER AND ON-EDGE STACKER

This invention relates to apparatus and a method for processing high-volume business mail. Such processing, for instance, can include stuffing of envelopes with inserts, variously conveying envelopes, and further handling of envelopes for eventual mailing. In particular, this invention relates to the diverting of envelopes from a conveying path with subsequent on-edge stacking of diverted envelopes.

Many present devices for stuffing inserts into envelopes include conveyors for seriatim transport of envelopes for a variety of further processing purposes. Almost invariably, such processing includes envelope selection and diversion from the stream on the basis of predetermined criteria and the stacking of envelopes to facilitate subsequent handling.

Requirements for equipment to be capable of more and more processing tasks and to operate at increasingly higher celerities with high reliabilities and short down-times have commonly increased mechanical and electrical complexity and, hence, cost.

Prior art diverter and on-edge stacker devices include those disclosed in U.S. Pat. No. 5,029,832. In particular also, a Division thereof, U.S. Pat. No. 5,201,504 (Fallos et al.), entitled "On-Edge Stacker", shows an envelope diverter device including a divert gate for selective interception and diversion of envelopes from a transport path to a different level. The disclosed device further includes a rotatable paddle 380 (FIG. 13) for propelling diverted envelopes in synchronized manner for delivery between legs 400 of a continuously revolving stacking spider device 353. The stacking spider deposits and stacks envelopes edge-on a surface in an accumulator. A mechanism is included for laterally offsetting envelopes.

In view of the foregoing, it is a feature of the present invention to provide improved apparatus and method for diverting and on-edge stacking of envelopes with reliable high-speed operation at relatively low equipment complexity and, hence, cost.

SUMMARY OF THE INVENTION

U.S. Pat. No. 5,201,504 (Fallos et al.), entitled "On-Edge Stacker", and commonly assigned herewith, is incorporated herein in its entirety by reference.

In accordance with principles of the present invention, there is provided a diverter device that diverts an envelope away from a conveying path for on-edge stacking in an accumulator. The device comprises means for intercepting and skewing an envelope being conveyed along its conveying path, means for capturing and nipping a portion of the skewed envelope, and means for driving the envelope into a gap between legs of a momentarily stationary spider wheel. The diverter device further includes means for sensing an envelope having been driven into a gap between the legs of the spider wheel. The means for capturing, nipping, and driving the envelope includes driven, revolving rollers. The spider wheel is driven by a stepper motor that is controlled by the sensing means. When stationary, the spider wheel is indexed in a position to offer an empty gap to the next expected envelope. Upon arrival of an envelope in the stationary and empty gap, and upon sensing of this event by the means for sensing, the spider wheel is rotated by the stepper motor by one gap pitch.

The means for skewing an envelope includes a plurality of selectively interposable means for intercepting a lateral portion of the leading edge of an envelope that is being transported, wherein each means for intercepting is interposable in a different location along the transport path of the envelope. Selective lateral offsetting of envelopes to form a stack with mutually offset portions can be achieved by appropriate selective interposing at different locations by the means for intercepting.

BRIEF DESCRIPTION OF THE DRAWINGS

The foregoing and other objects, features, and advantages of the invention will be apparent from the following more particular description of preferred embodiments of the invention, as illustrated in the accompanying drawings in which like reference numerals refer to like parts throughout different views. The drawings are schematic and not necessarily to scale, emphasis instead being placed upon illustrating principles of the invention.

DESCRIPTION OF THE PREFERRED EMBODIMENTS

Figure 1:
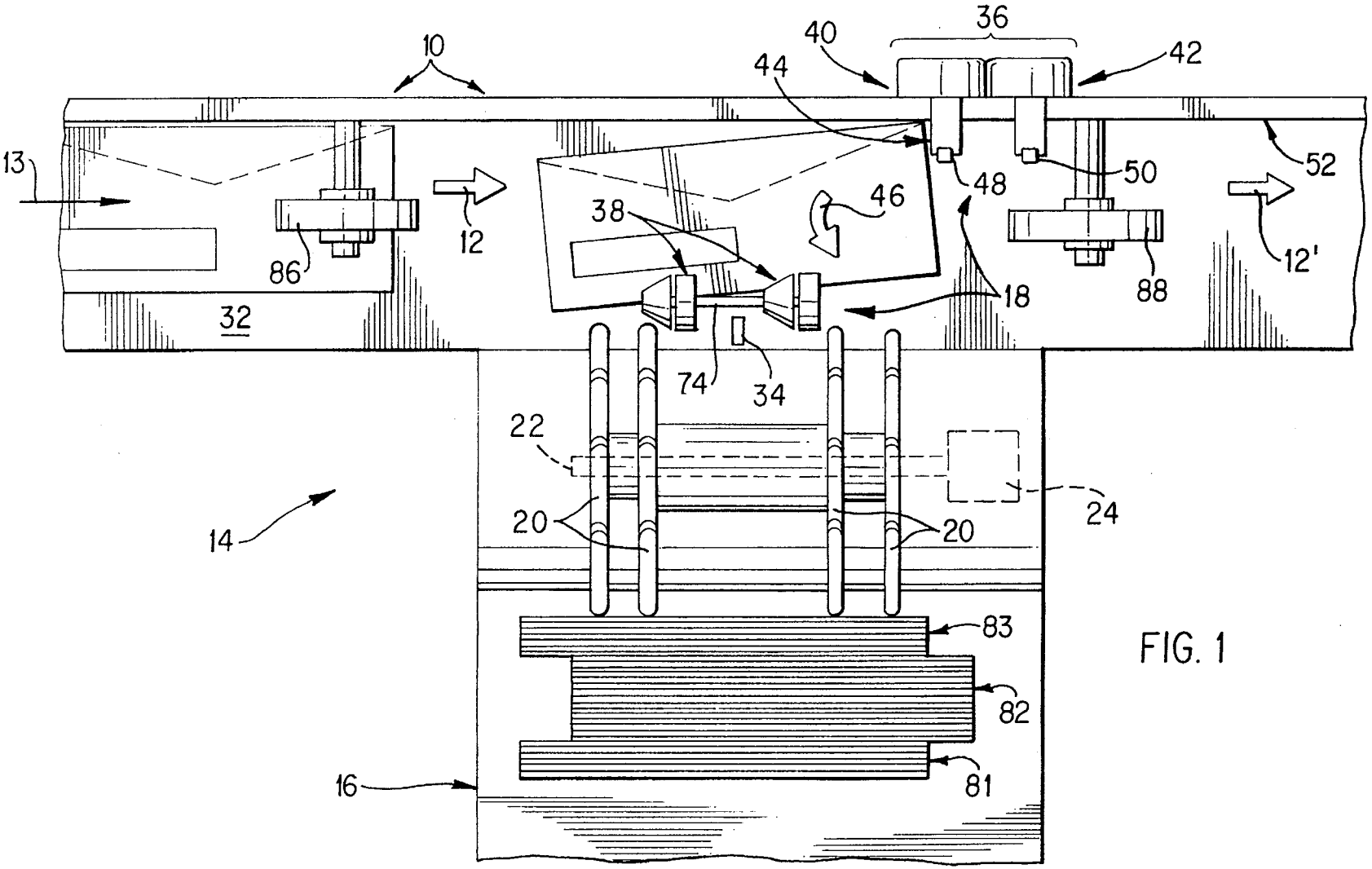
FIG. 1 is a fragmental, schematic top view of an embodiment of the apparatus according to principles of this invention.
Figure 2:
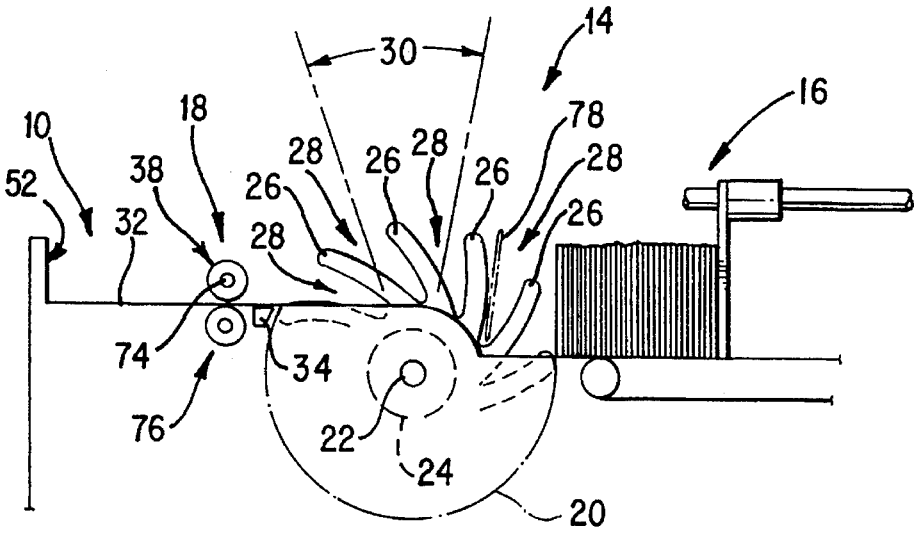
FIG. 2 is a fragmental, schematic, partial side view of a portion of the apparatus shown in FIG. 1.

Referring to FIGS. 1 and 2 of the drawings, a fragmental portion of a mail-processing machine is schematically shown. In particular, there is depicted: a portion of a conveyor 10 for conveying envelopes along a conveying path 13 that is also defined by conveying path direction arrows 12 and 12'; a portion of a spider wheel device 14; a portion of an on-edge stacking accumulator 16; and, portions of an envelope diverter 18.

Spider wheel 14 includes parallel spider wheels 20 commonly mounted on a shaft 22 and incrementally rotatable by a stepper motor 24. Spider wheel 20 has a number of legs 26 and therebetween gaps 28 spaced at an angular pitch 30. A surface 32 is common to conveyor 10 and diverter 18; it is the surface along which an envelope is conveyed in conveyor 10 and along which an envelope is diverted by diverter 18 into a gap 28 of spider wheels 20. A sensor 34 is disposed in or near surface 32 in the approach region of a diverted envelope to spider wheel 20 so as to be capable of sensing passage or transport of a diverted envelope into a gap 28.

Sensor 34 is connected to and controls stepper motor 24 in such a manner that the sensing of an envelope being or having been delivered into a gap 28 causes stepper motor 24 to rotate spider wheel 20 by angular pitch 30 and then stop. Thusly, the next gap 28 is moved into position to receive the next diverted envelope.

A photoelectric or photosensor device is preferred as sensor 34, but many conventional sensing or detecting devices can be employed. For instance, a mechanical feeler switch can provide the needed function.

Envelope diverter 18 includes skewing means 36 for skewing a conveyed envelope and a roller device 38 for engaging and transporting a skewed envelope away from the conveying path 13 and into one of the gaps 28.

Skewing means 36 comprises intercepting means 40 and 42. The intercepting means serve for intercepting a lateral portion 44 of the leading edge of an envelope (that is to be diverted) as the envelope is conveyed along conveying path 13. The intercepting means causes skewing of the envelope upon such interception, as particularly shown in FIG. 1 wherein the skewing of an envelope is indicated by arrow 46.

Intercepting means 40,42 include interposers 48, 50, respectively. An interposer is selectively movable between a position in which a conveyed envelope can pass by unobstructedly (without being intercepted) and an interception position in which further passage of a conveyed envelope is blocked and the envelope is skewed. The skewing action results from the force due to the inertia of the conveyed envelope (acting through the center of gravity of the envelope) and the blockage of motion by an interposer at a lateral side of the leading edge of the envelope. The resulting force couple acts to turn or skew the envelope on surface 32 as indicated by arrow 46.

Each of the interposers 48, 50 is selectively interposable. As the position for interception of an envelope is different (along the conveying path 13), depending on which interposer is selected and interposed, the envelope is stopped and skewed in a different location along the conveying path 13.

For instance, the shown stopping-and-skewing location (where interposer 48 is intercepting the envelope) causes the diverted envelope to be transported and stacked in a laterally offset form as given by the shown third stack portion 83 in accumulator 16. If interposer 50 is selected to intercept the conveyed envelope that is intended to be diverted from the conveying path 13, that envelope is stacked in the laterally relatively offset form as indicated by the second stack portion 82. Additional interposers at different locations can provide for further offsets. Offsets are used to distinguish according to preselected characteristics of envelopes (for instance, ZIP codes) in a stack so that the stack can be disassembled or otherwise selectively processed in accordance with such characteristics.

Spacings between the locations of intercepting means along conveying path 13 substantially correspond to the relative lateral offset achieved in the stack.

An intercepting means can comprise a solenoid-moved interposer, wherein, for instance, interposer 48 is normally recessed in wall 52 so as not to obstruct passage of a conveyed envelope. When selectively actuated, the solenoid advances the interposer into the conveying path, as shown in FIG. 1. Various other suitable, conventional mechanisms can be employed as intercepting means without detracting from the required functionality. For example, as indicated in FIG. 4, an intercepting means 54 can comprise a rotary solenoid 56 that selectively rotates an interposer arm 58 between an envelope-intercepting position and a position out of the envelope conveying path.

It has also been found advantageous to employ interposers that include a degree of resiliency in their interposed position so that bounce of an envelope (upon interception) is reduced or avoided. Appropriate spring-loading or spring-damping is provided in a variety of conventional ways. For instance, rotary solenoids of a common type include a spring-loaded off or on position and can be employed if the loading is appropriately matched to the damping task of the interposer. Inherently present friction can provide energy dissipation and adequate damping in conjunction with spring loading or other resilient loading.

Figure 4:
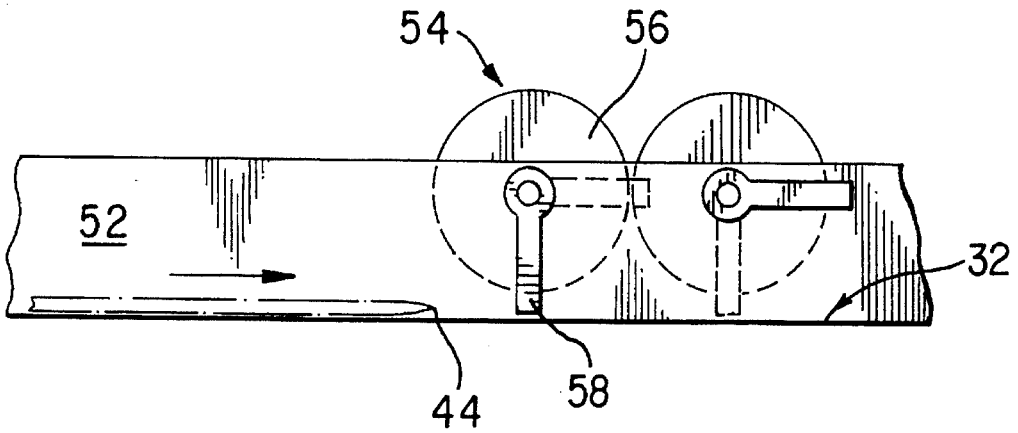
FIG. 4 is a schematic, enlarged, detailed, frontal view of components of the apparatus shown in FIG. 1.
Figure 4A:
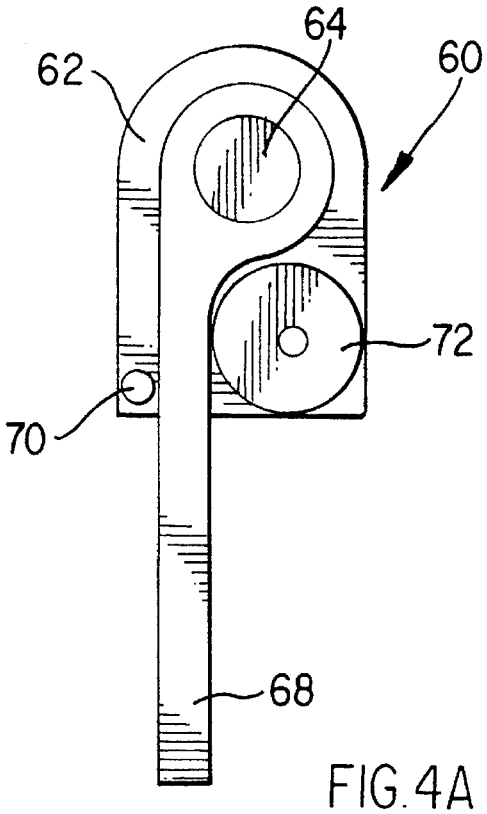
FIG. 4A is a schematic, frontal view of an alternate embodiment to the FIG. 4 structure.

In the above regard, FIG. 4A illustrates an example of a spring-damped interposer arm 60, which can replace arm 58 in FIG. 4. As shown in FIG. 4A, interposer arm 60 comprises a yoke 62 that is fastened on and rotatable by solenoid axle 64. Arm 60 further comprises a lever arm 68 mounted freely revolvably about axle 64. Affixed to yoke 62 is a stop pin 70 and a resilient block 72 which acts as a spring. Lever arm 68 is constrained between pin 70 and block 72 so that it has to rotate together with yoke 62, yet arm 68 may be forceably rotated by a small amount against block 72 while resiliently compressing the block material. The block can be made of rubber or other elastomeric materials, or it can be provided in form of an appropriate spiral spring. For example, interposer arm 60 (of FIG. 4A) can replace interposer arm 58 in FIG. 4 to provide spring-damping during interception of a conveyed envelope for diversion of the envelope.

Further in respect to FIGS. 1 and 2, roller device 38 (of envelope diverter 18) basically includes a pair of friction rollers commonly mounted on and driven via a shaft 74. The device can include nipping counter rollers 76 (FIG. 2) disposed beneath surface 32 and contacting the rollers above the surface.

As shown in FIG. 1, in operation, an envelope is skewed and moved thereby with a side edge at first beneath the left roller of roller device 38. The envelope is nipped (captured) thereby and diverted farther away from wall 52 and from the conveying path 13 also into the nip of the right roller of roller device 38. The envelope is thereby transported away from conveying path 13 toward spider wheel device 14 and into a gap 28 of spider wheels 20. Further operation of the device includes the already described sensing (by sensor 34) of the envelope's delivery into gap 28 and the consequent control and actuation of stepper motor 24 to rotate (clockwise) the spider wheels 20 by angular pitch 30 and then stop. The latter part of the operation offers up a next gap ready to receive a next diverted envelope.

As a number of diverted envelopes are received in gaps 28, successive incremental rotation of wheels 20 brings envelopes to a surface of accumulator 16, as indicated in FIG. 2 by envelope 78 (shown by phantom lines). Envelopes are collected there from the gaps 28 and are stacked edge-on upon the accumulator surface.

The conveying of envelopes along conveying path 13 is shown here by drive roller arrangements 86,88. These can simply convey envelopes by friction between the respective driven roller and surface 32. Alternately, for example, the rollers above surface 32 have counter-rollers disposed beneath surface 32 and appropriate openings are provided in the surface therebetween such that envelopes are nipped and conveyed between respective rollers and counter-rollers. Alternately, other appropriate conventional conveying mechanisms can be used.

Figure 3:
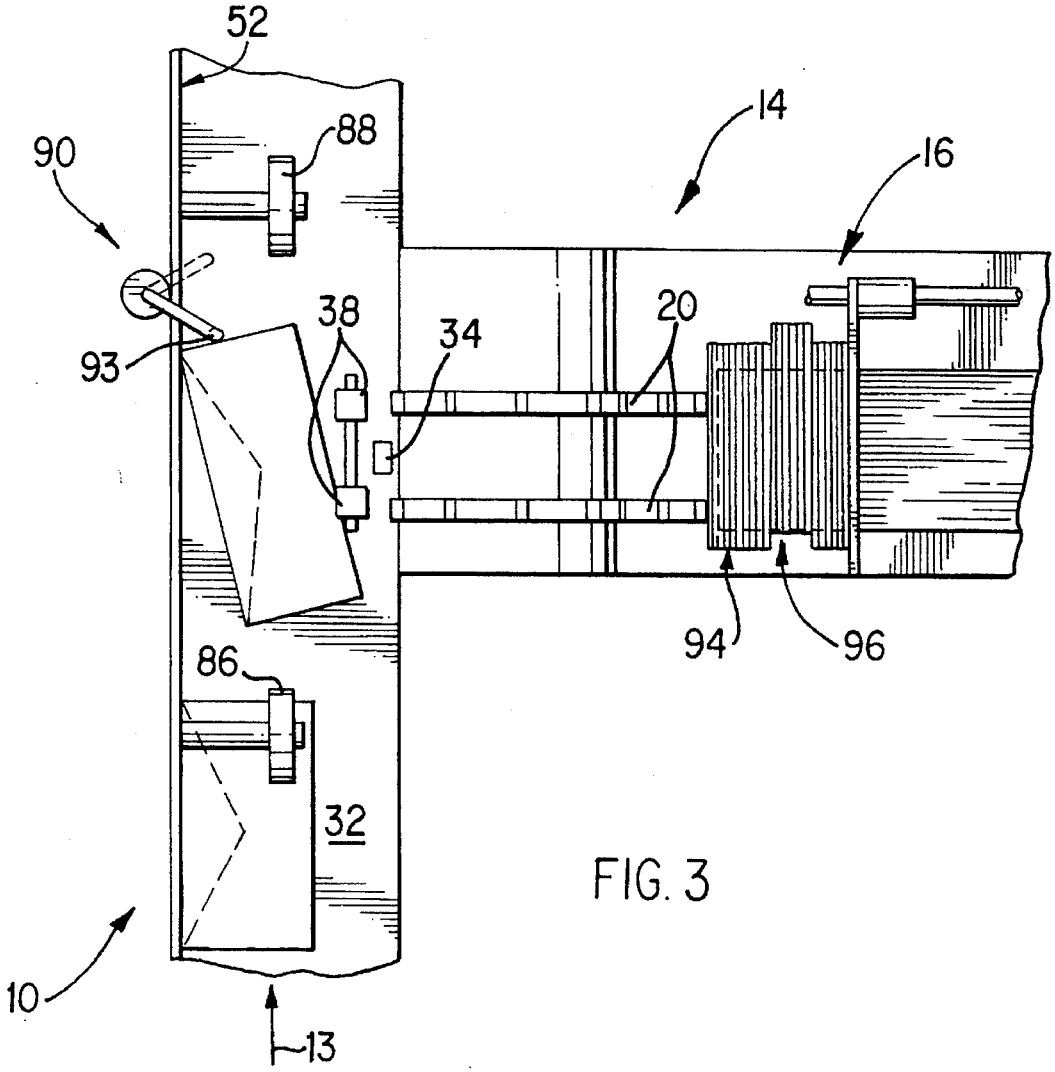
FIG. 3 is a fragmental, schematic plan view of another embodiment including portions depicted in FIGS. 1 and 2.
Figure 5:
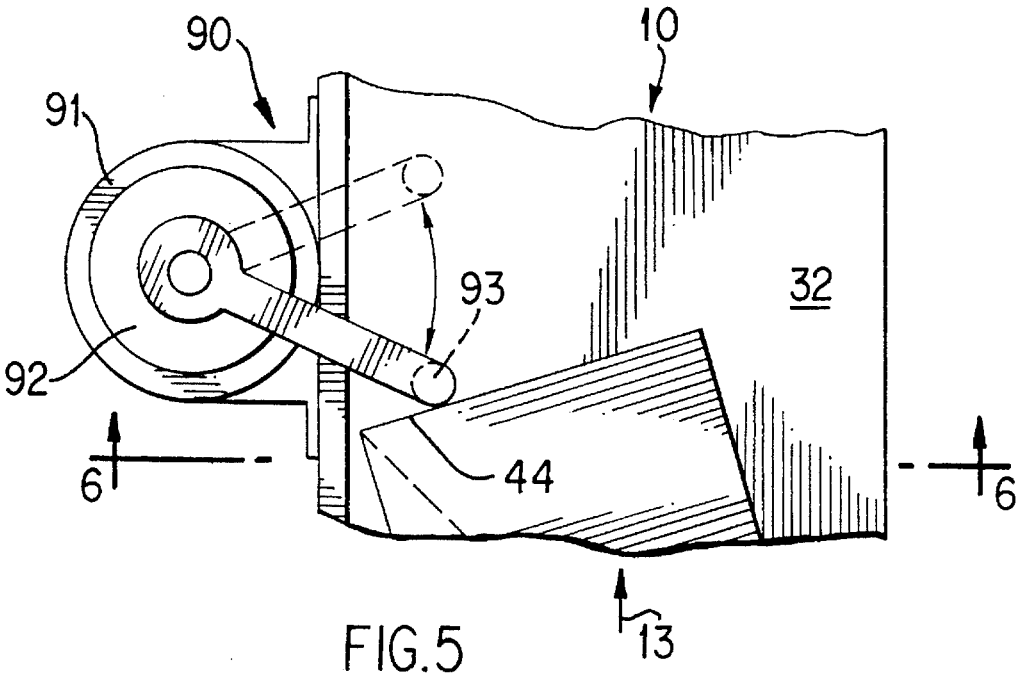
FIG. 5 is a schematic, enlarged, detail view of portions shown in FIG. 3; and, FIG. 6 is a schematic, side view and section of the components shown in FIG. 5.
Figure 6:
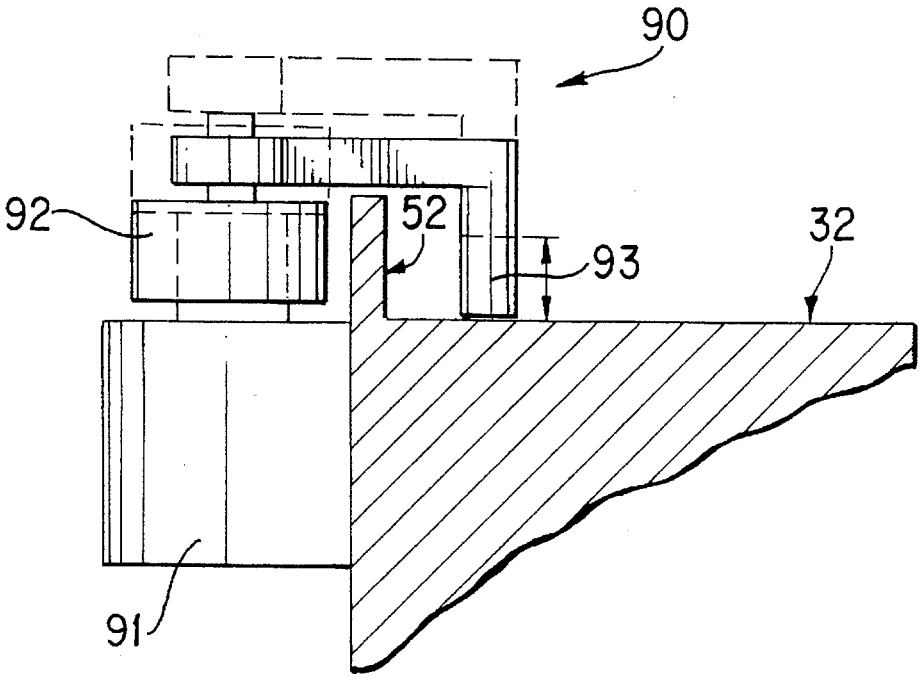

Referring now to FIGS. 3, 5, and 6, there is shown another embodiment of the invention, wherein the skewing means 90 comprises intercepting means 91, offsetting means 92, and an interposer 93. Interposer 93 is selectively interposable in the conveying path 13 selectively at different locations spaced therealong. In other respects, the apparatus illustrated in FIG. 3 corresponds substantially to the apparatus depicted in FIGS. 1 and 2. The important different feature being that interposer 93 is selectively relocatable to and interposable at different locations along the conveying path 13 for the purpose of obtaining different offsets in the accumulated stack, as schematically illustrated in FIG. 3 by the mutually offset stack portions 94 and 96.

It will be clear, in view of the foregoing discussions, that the relative spacing between locations of selective interception of envelopes by an interposer along conveying path 13 substantially corresponds to the amount of relative offset obtained in a stack of envelopes in accumulator 16.

Referring now more particularly to FIGS. 5 and 6 (in conjunction with FIG. 3), skewing means 90 is there illustrated in detail. As shown, intercepting means 91 includes a linear solenoid upon whose armature (up and down movable)is mounted a rotary solenoid which is comprised in offsetting means 92. Mounted upon the shaft of the rotary solenoid is an arm including interposer 93. As illustrated, interposer 93 is in intercepting position interposed in conveying path 13. Energizing or respectively de-energizing the solenoid of intercepting means 91 lifts interposer 93 up and out of the position of interception with a conveyed envelope. Energizing or respectively de-energizing the rotary solenoid of offsetting means 92 rotates interposer 93 into a different location (shown by dashed lines) along conveying path 13. When interposer 93 is lowered into interception position, while in such different location, an intercepted envelope is diverted at a different offset and is stacked in accumulator 16 with this offset.

While the invention has been particularly shown and described with reference to preferred embodiments thereof, it will be understood by those skilled in the art that various changes and modifications in form and details may be made therein without departing from the spirit and scope of the invention.

The embodiments of the invention in which an exclusive property or privilege is claimed are as follows:

1. A diverter and on-edge stacker for envelopes, comprising:

a conveying path for envelopes;

a spider wheel having legs and therebetween gaps, said gaps defining an angular pitch therebetween;

means for sensing an envelope being transported into one of said gaps;

means for rotating said spider wheel by said angular pitch in response to sensing by said means for sensing of an envelope being transported into one of said gaps;

means for diverting conveyed envelopes selectively from said conveying path, said means for diverting including:

means for skewing a conveyed envelope, and means for capturing and transporting the skewed envelope away from said conveying path and into one of said gaps.

2. The apparatus in accordance with claim 1, wherein said means for skewing includes means for intercepting a lateral portion of the leading edge of an envelope conveyed along said conveying path.

3. The apparatus of claim 2, wherein said means for intercepting comprises one or more interposers, each of said one or more interposers being selectively interposable in said conveying path at a different location therealong.

4. The apparatus of claim 3, wherein at least one of said one or more interposers includes means for spring-damping the interception of an envelope that is conveyed along said conveying path.

5. The apparatus of claim 2, wherein said means for intercepting includes means for selectively offsetting a diverted envelope laterally with respect to the direction of transport of said envelope by said means for capturing and transporting envelopes into one of said gaps.

6. The apparatus of claim 5, wherein said means for selectively offsetting includes a plurality of interposers, each one of said plurality of interposers being selectively interposable in said conveying path at a different location therealong, whereby different locations are spaced from one another substantially by the amount of relative offset.

7. The apparatus of claim 5, wherein said means for selectively offsetting includes an interposer, said interposer being selectively interposable at different locations spaced along said conveying path, whereby the relative spacings between locations correspond substantially to the relative offset.

8. The apparatus in accordance with claim 1, wherein said means for sensing includes a photosensor.

9. The apparatus in accordance with claim 1, wherein said means for rotating includes a stepper motor.

10. The apparatus in accordance with claim 1, wherein said means for capturing and transporting includes a driven revolving roller for engaging and driving of a skewed envelope.

11. A method of diverting and on-edge stacking of envelopes, comprising the steps of:

conveying envelopes along a conveying path;

diverting conveyed envelopes selectively from said conveying path, said step of diverting including:

skewing a conveyed envelope, and capturing and transporting the skewed envelope away from said conveying path into one of a plurality of gaps between legs of a spider wheel, said plurality of gaps defining an angular pitch between adjacent ones of said plurality of gaps;

sensing an envelope being transported into one of said plurality of gaps; and, rotating said spider wheel by said angular pitch in response to said step of sensing.

12. The method according to claim 11, wherein said step of skewing includes a step of intercepting a lateral portion of the leading edge of a conveyed envelope and stopping said conveying.

13. The method of claim 12, wherein said step of intercepting and stopping includes a step of selectively interposing one of one or more interposers in said conveying path, wherein said interposing is effected selectively in different locations along said conveying path by a correspondingly different one of said one or more interposers.

14. The method of claim 12, wherein said step of intercepting and stopping includes a step of spring-damping said stopping.

15. The method of claim 12, wherein said step of intercepting and stopping includes a step of selectively offsetting a diverted envelope laterally with respect to the direction of said transporting.

16. The method of claim 15, wherein said step of selectively offsetting includes a step of selectively intercepting and stopping said conveying at different locations along said conveying path.

17. The method of claim 15, wherein said step of selectively offsetting is effected by selectively interposing an interposer in said conveying path at different locations therealong.

18. The method according to claim 11, wherein said step of sensing includes photosensing.

19. The method according to claim 11, wherein said step of rotating includes stepping said spider wheel in angular increments by a stepper motor.

20. The method according to claim 11, wherein said step of capturing and transporting includes engaging and driving the skewed envelope by a driven revolving roller.

* * * * *